US007239830B2

(12) United States Patent
Kim et al.

(10) Patent No.: US 7,239,830 B2
(45) Date of Patent: Jul. 3, 2007

(54) COLOR IMAGE FORMING SYSTEM AND METHOD OF FORMING COLOR IMAGE USING THE SYSTEM

(75) Inventors: Kyung Hwan Kim, Gyeonggi-do (KR); Vong Gun Kim, Tokyo-do (JP); Min Ho Choi, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/081,745

(22) Filed: Mar. 17, 2005

(65) Prior Publication Data

US 2005/0158079 A1 Jul. 21, 2005

Related U.S. Application Data

(62) Division of application No. 10/446,807, filed on May 29, 2003.

(30) Foreign Application Priority Data

Jun. 15, 2002 (KR) ..... 2002-33479
Apr. 28, 2003 (KR) ..... 2003-26680

(51) Int. Cl.
*G03G 15/01* (2006.01)

(52) U.S. Cl. ..... 399/223; 399/226

(58) Field of Classification Search ..... 399/107, 399/119, 223, 225, 226, 227
See application file for complete search history.

(56) References Cited

U.S. PATENT DOCUMENTS 6,061,535 A * 5/2000 Yokomori et al. ..... 399/61
6,198,893 B1 3/2001 Icikawa et al. ..... 399/223
6,285,841 B1 * 9/2001 Miho ..... 399/55
6,308,018 B1 * 10/2001 Yoshida et al. ..... 399/53

FOREIGN PATENT DOCUMENTS

KR 2000-52579 8/2000

* cited by examiner

*Primary Examiner*—Hoang Ngo
(74) *Attorney, Agent, or Firm*—Staas & Halsey LLP

(57) ABSTRACT

A color image forming system including a photosensitive drum, a charger which charges the photosensitive drum, and a laser scanning unit which is installed below the photosensitive drum and radiates light onto the charged photosensitive drum, to form an electrostatic latent image. The system further includes a plurality of developing units with toner of at least four colors such as yellow, magenta, cyan, and black, arranged at different heights along the outer surface of the photosensitive drum to develop the electrostatic latent image with the toner when a developing roller installed in each of the developing units is maintained at a developing gap with the photosensitive drum. A transfer unit transfers the developed image onto a piece of paper, and a fusing unit is installed above the photosensitive drum and fuses the transferred image onto the piece of paper. The developing units may be arranged in the order of magenta, cyan, yellow, and black.

2 Claims, 10 Drawing Sheets

COLOR IMAGE FORMING SYSTEM AND METHOD OF FORMING COLOR IMAGE USING THE SYSTEM

CROSS-REFERENCE TO RELATED APPLICATIONS

This application is a divisional application of application Ser. No. 10/446,807, filed May 29, 2003 and also claims the benefit of Korean Application No. 2002-33479, filed Jun. 15, 2002, in the Korean Intellectual Property Office, and Korean Application No. 2003-26680, filed Apr. 28, 2003, in the Korean Intellectual Property Office, the disclosures of which are incorporated herein by reference.

BACKGROUND OF THE INVENTION

1. Field of the Invention

The present invention relates to a color image forming system, and more particularly, to a color image forming system having a multi-path method using electrophotography.

2. Description of the Related Art

Conventional color image forming systems using electrophotography radiate light onto a photosensitive body charged to a predetermined potential, form an electrostatic latent image, develop the electrostatic latent image with toner having a predetermined color using a developing unit, fuse the developed electrostatic latent image onto paper and form a color image. The colors of toner used in color image forming systems include yellow (Y), magenta (M), cyan (C), and black (K). Thus, four developing units, each to develop only one of the four colors of toner, are necessary.

Methods of forming a color image include a single path method using four exposing units and photosensitive bodies, and a multi-path method using one exposure unit and one photosensitive body.

FIG. 1 illustrates a color image forming system using the single-path method. As shown in FIG. 1, the color image forming system using the single-path method includes photosensitive bodies (drums) 120C, 120M, 120Y, and 120K, exposing units 110C, 110M, 110Y, and 110K, and developing units 130C, 130M, 130Y, and 130K provided for toner having four colors such as cyan (C), magenta (M), yellow (Y), and black (K). Each of the photosensitive drums 120C, 120M, 120Y, and 120K is placed near a transfer belt 140. The transfer belt 140 is driven by two driving rollers 150 at a predetermined speed. The transfer belt 140 is placed between one of the two driving rollers 150 and a transfer roller 160, and a piece of paper S is transferred between the transfer roller 160 and the transfer belt 140.

The method of forming a color image using the above structure is as follows. First, light which corresponds to image information of cyan (C) color, is radiated by the exposing unit 110C onto the photosensitive drum 120C, thereby forming an electrostatic latent image. Then, a toner of cyan (C) color stored in the developing unit 130C is attached to the electrostatic latent image, a toner image of cyan (C) color is formed on the photosensitive drum 120C, and the toner image is transferred onto the transfer belt 140. At a predetermined amount of time after exposure of the photosensitive drum 120C with the light from the exposing unit 110C corresponding to image information of the cyan (C) color, the exposing unit 110M radiates light which corresponds to image information of magenta (M) color, onto the photosensitive drum 120M, and forms an electrostatic latent image. Then, a toner of magenta (M) color stored in the developing unit 130M is attached to the electrostatic latent image, a toner image of magenta (M) color is developed onto the photosensitive drum 120M, and the toner image is transferred onto the transfer belt 140. In this case, the starting time of exposure by each of the exposing units 110C and 110M is adjusted such that the toner image of cyan (C) color and the toner image of magenta (M) color that are transferred onto the transfer belt 140 are precisely overlapped on the transfer belt 140. Subsequently and in the exact same way, toner images of yellow (Y) and black (K) colors are also transferred onto the transfer belt 140, thereby forming color toner images. These color toner images are transferred onto the piece of paper S passing between the transfer belt 140 and the transfer roller 160, and are fused by a fusing unit 170 onto the piece of paper S by heat and pressure, thereby forming a complete color image.

In a color image forming system using the single-path method, a complete color image may also be formed by rotating the transfer belt 140 once. Alternately, a black-and-white image is formed by rotating the transfer belt 140 once. That is, the time required to color print is the same as the time required for black-and-white printing. Thus, the single-path method is widely used in high-speed color image forming systems.

However, if an exposure starting time is not precisely adjusted in consideration of the relative positions of the exposing units 110 and the relative positions of the photosensitive drums 120, the toner images of each color are not precisely overlapped on the transfer belt 140. Thus, a good quality color image cannot be obtained. In addition, since the four exposing units 110 and the four photosensitive drums 120 are necessary, the price of the color image forming system becomes higher.

Another type of color image forming system, which avoids the above problems, operates in a comparatively low-speed region, adopts one photosensitive drum and one exposing unit, and employs a multi-path method of forming a color image by repeating exposure, development, and transfer operations for each color. Multi-path methods include a rotary method and a slider method which differ in the arrangement of the developing units for each color and the way in which an individual developing unit is activated.

FIG. 2 illustrates a color image forming system using the rotary method. As shown in FIG. 2, the color image forming system using the rotary method includes one photosensitive drum 220, one exposing unit 210 which radiates light onto the photosensitive drum 220, a transfer belt 240 placed near the photosensitive drum 220, and a rotating turret 280. Four developing units 230C, 230M, 230Y, and 230K are arranged to each occupy one quarter (90 degrees) of the turret 280. As the turret 280 rotates, the four developing units 230C, 230M, 230Y, and 230K sequentially arrive directly opposite to the photosensitive drum 220. The length of the transfer belt 240 is equal to or greater than a maximum length of the piece of paper S used in the color image forming system.

The operation of a color image forming system having the above structure is as follows. If the turret 280 rotates so that the cyan (C) developing unit 230C is opposite to the photosensitive drum 220, light corresponding to image information of cyan (C) color is radiated by the exposing unit 210 onto the photosensitive drum 220, thereby forming an electrostatic latent image. Then, the toner of cyan (C) color stored in the developing unit 230C is attached to the electrostatic latent image, a toner image of cyan (C) color is formed on the photosensitive drum 220, and the toner image is transferred onto the transfer belt 240.

After the formation of the toner image of cyan (C) color on the transfer belt 240 is completed, the turret 280 rotates by 90 degrees so that the magenta (M) developing unit 230M is opposite to the photosensitive drum 220, light corresponding to image information of magenta (M) color is radiated by the exposing unit 210 onto the photosensitive drum 220, thereby forming an electrostatic latent image. Then, the toner of magenta (M) color stored in the developing unit 230M is attached to the electrostatic latent image, a toner image of magenta (M) color is formed on the photosensitive drum 220, and the toner image is transferred onto the transfer belt 240.

In this case, the time at which the exposing unit 210 begins radiating light corresponding to the image information of magenta (M) color is adjusted in consideration of the transfer speed of the transfer belt 240, so that the front end of the toner image of the cyan (C) color formed previously on the transfer belt 240 is precisely consistent with the front end of the toner image of the magenta (M) color being transferred onto the transfer belt 240 from the photosensitive drum 220.

After toner images having cyan (C), magenta (M), yellow (Y), and black (K) colors are overlapped and formed on the transfer belt 240 by repeating the above operations for yellow (Y) and black (K) colors, the toner images are transferred and fused onto the piece of paper S to produce a color image.

FIG. 3 illustrates a color image forming system using the slider method. As shown in FIG. 3, four developing units 330C, 330M, 330Y, and 330K are arranged in the traveling direction of a photosensitive belt 320, and a cam 380 which selectively slides each of the developing units 330C, 330M, 330Y, and 330K out in a horizontal direction, one at a time, is provided.

The developing units 330C, 330M, 330Y, and 330K are initially placed so that a developing roller 331 is separated from the photosensitive belt 320 by an initial distance Di. Here, the initial distance Di is greater than a developing gap Dg (not shown) which allows toner attached to the developing roller 331 to be attached to the photosensitive belt 320. Thus, when each of the developing units 330C, 330M, 330Y, and 330K is separated from the photosensitive belt 320 by the initial distance Di, toner is not attached to the photosensitive belt 320 from the developing units 330C, 330M, 330Y, and 330K. However, when an image is formed, the cam 380 is rotated to slide a selected developing unit (230M in FIG. 3) toward the photosensitive belt 320 until the distance between the selected developing unit (230M in FIG. 3) and the photosensitive belt 320 is equal to the developing gap Dg. Thus, a development operation can be performed by only one selected developing unit at a time.

On the basis of the above configuration, the developing units 330C, 330M, 330Y, and 330K are selectively slid toward the photosensitive belt 320 by selectively operating the cam 380 so as to perform the development operation for each of cyan (C), magenta (M), yellow (Y), and black (K) colors, toner images of each color are formed on a transfer belt 340, are transferred onto the piece of paper S, and are fused onto the piece of paper S, thereby forming a color image.

However, in color image forming systems using a multi-path method and having either of the configurations shown in FIGS. 2 and 3, unselected developing units 230, 330 are separated from the photosensitive belt 320 or the photosensitive drum 220 by a distance greater than the developing gap Dg so that toners of the unselected developing units are prevented from attaching to the photosensitive drum 220 or the photosensitive belt 320 and contaminating the resultant color image. The developing units 230, 330 must be moved by rotating the turret 280 or operating the cam 380 so that only one selected developing unit 230, 330 at a time is placed a distance equal to the developing gap Dg away from the photosensitive belt 320 or the photosensitive drum 220. Thus, in order to rotate the turret 280 or operate the cam 380, an additional driving motor (not shown) must be provided. Otherwise, if an existing driver (not shown) of the color image forming system is used with a motor (not shown) to drive the photosensitive drum 220, a complicated apparatus for power conversion should be provided.

Hence, noise occurs when the turret 280 rotates or the cam 380 operates. Due to shock caused by the operation of the turret 280 or the cam 380, the lifespan of the driver (not shown) may be reduced. Moreover, such shock causes bands or jitter which reduces the quality of the resulting color image.

SUMMARY OF THE INVENTION

Accordingly, it is an object of the present invention to provide a color image forming system which performs a development operation using a multi-path method in which each developing roller installed in a plurality of developing units is neither attached to a photosensitive drum nor widely separated from the photosensitive drum, but is maintained at a developing gap.

It is another object of the present invention to provide a color image forming system having an improved structure which yields high printing quality for each color of the plurality of developing units.

Additional objects and advantages of the invention will be set forth in part in the description which follows and, in part, will be obvious from the description, or may be learned by practice of the invention.

The foregoing and/or other objects of the present invention may be achieved by providing a color image forming system including a photosensitive drum; a charger which charges the photosensitive drum; a laser scanning unit which is installed below the photosensitive drum, radiates light onto the charged photosensitive drum, and forms an electrostatic latent image; a plurality of developing units respectively having toners of yellow, magenta, cyan, and black, arranged at different heights relative to an outer surface of the photosensitive drum, to develop the electrostatic latent image with the toner, the developing units each including a developing roller maintained at a developing gap with respect to the photosensitive drum; a transfer unit which transfers the developed image onto a piece of paper; and a fusing unit which is installed above the photosensitive drum to fuse the transferred image onto the piece of paper, wherein the developing units are arranged based on the respective toner colors in the order of magenta, cyan, yellow, and black from the laser scanning unit to the fusing unit.

The foregoing and/or other objects of the present invention may also be achieved by providing a color image forming system including a photosensitive drum; a charger which charges the photosensitive drum; a laser scanning unit which is installed below the photosensitive drum, radiates light onto the charged photosensitive drum, and forms an electrostatic latent image thereon; a plurality of developing units respectively having toners of yellow, magenta, cyan, and black, arranged at different heights relative to an outer surface of the photosensitive drum, to develop the electrostatic latent image with the toner, the developing units each including a developing roller maintained at a developing gap with respect to the photosensitive drum; a transfer unit which transfers the developed image onto a piece of paper; and a fusing unit which is installed above the photosensitive drum and fuses the transferred image onto the piece of paper, wherein the developing units are arranged based on the respective toner colors in the order of yellow, magenta, cyan, and black, from the laser scanning unit to the fusing unit.

The foregoing and/or other objects of the present invention may also be achieved by providing a method including preparing a photosensitive drum, a charger which charges the photosensitive drum, a laser scanning unit which is installed below the photosensitive drum, radiates light onto the charged photosensitive drum, and forms an electrostatic latent image thereon, a plurality of developing units respectively having toners of magenta, cyan, yellow, and black, arranged at different heights relative to an outer surface of the photosensitive drum to develop the electrostatic latent image with the toner when a developing roller installed in each of the developing units is maintained at a developing gap with respect to the photosensitive drum, a transfer unit which transfers the developed image onto a piece of paper, and a fusing unit which is installed above the photosensitive drum and fuses the transferred image onto the piece of paper; developing a plurality of monochromatic images using the developing units and overlapping the monochromatic images on the transfer unit to produce a full color image; transferring the full color image onto the piece of paper using the transfer unit; and fusing the transferred image onto the piece of paper using the fusing unit, wherein the developing is performed in the order of yellow, cyan, magenta, and black.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
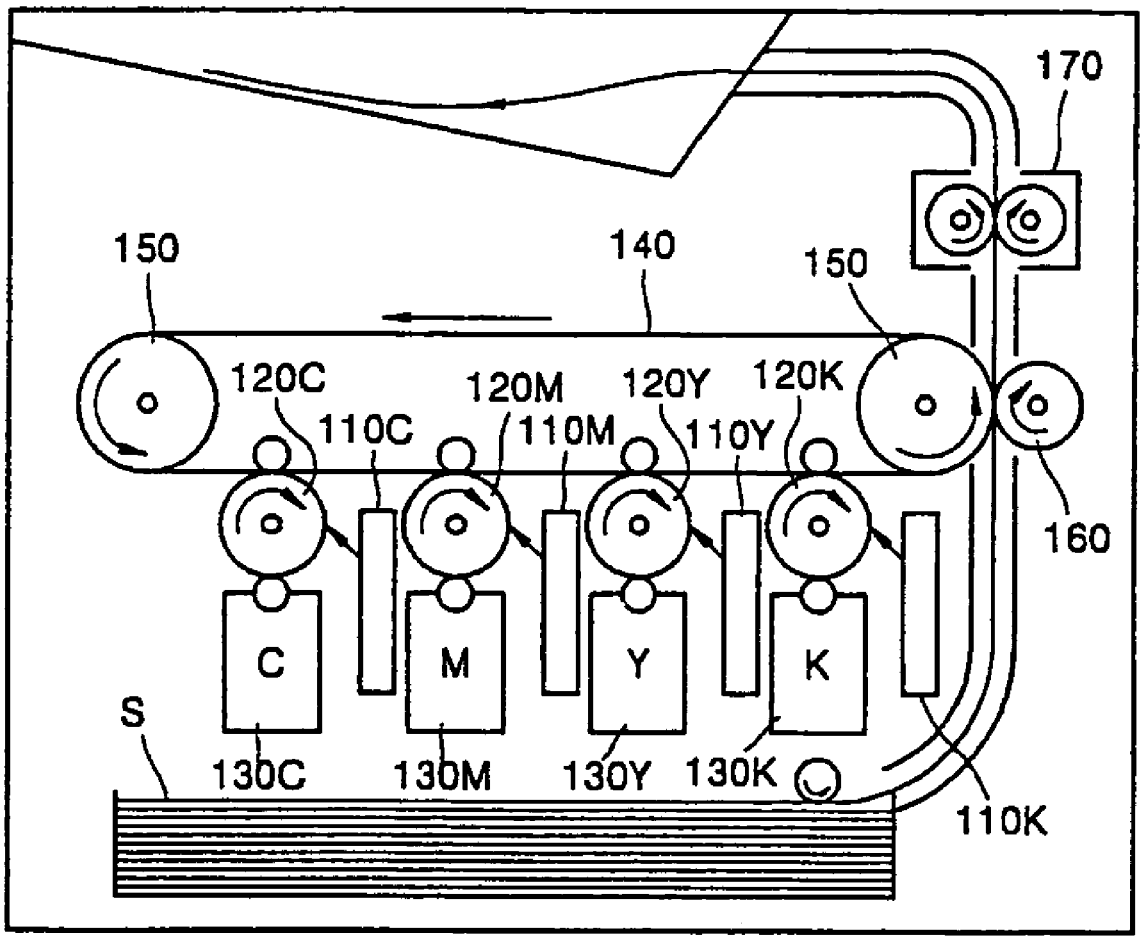
FIG. 1 (PRIOR ART)
FIG. 1 illustrates a conventional color image forming system using a single-path method.
Figure 2:
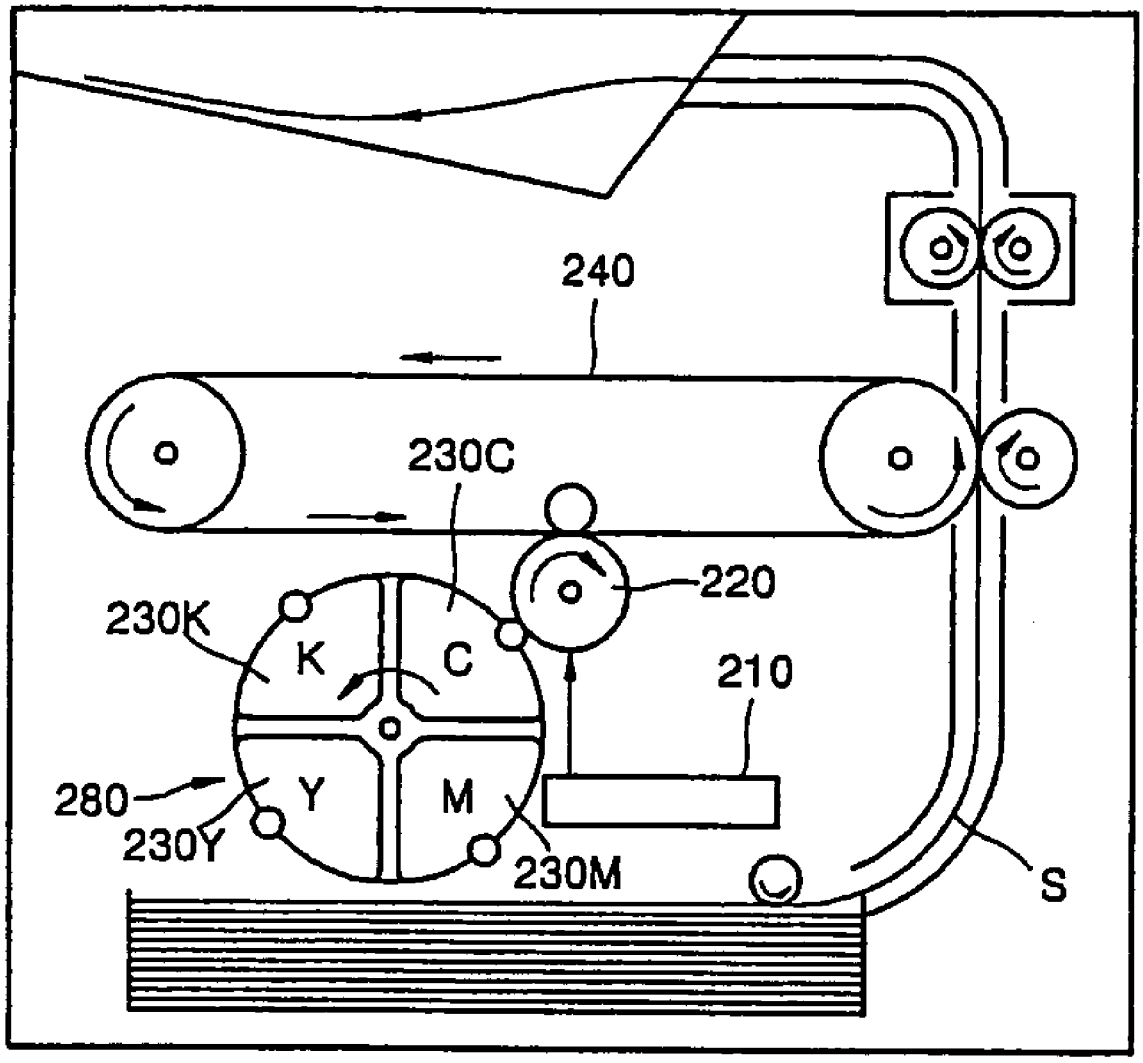
FIG. 2 (PRIOR ART)
FIG. 2 illustrates a conventional color image forming system using a rotary method.
Figure 3:
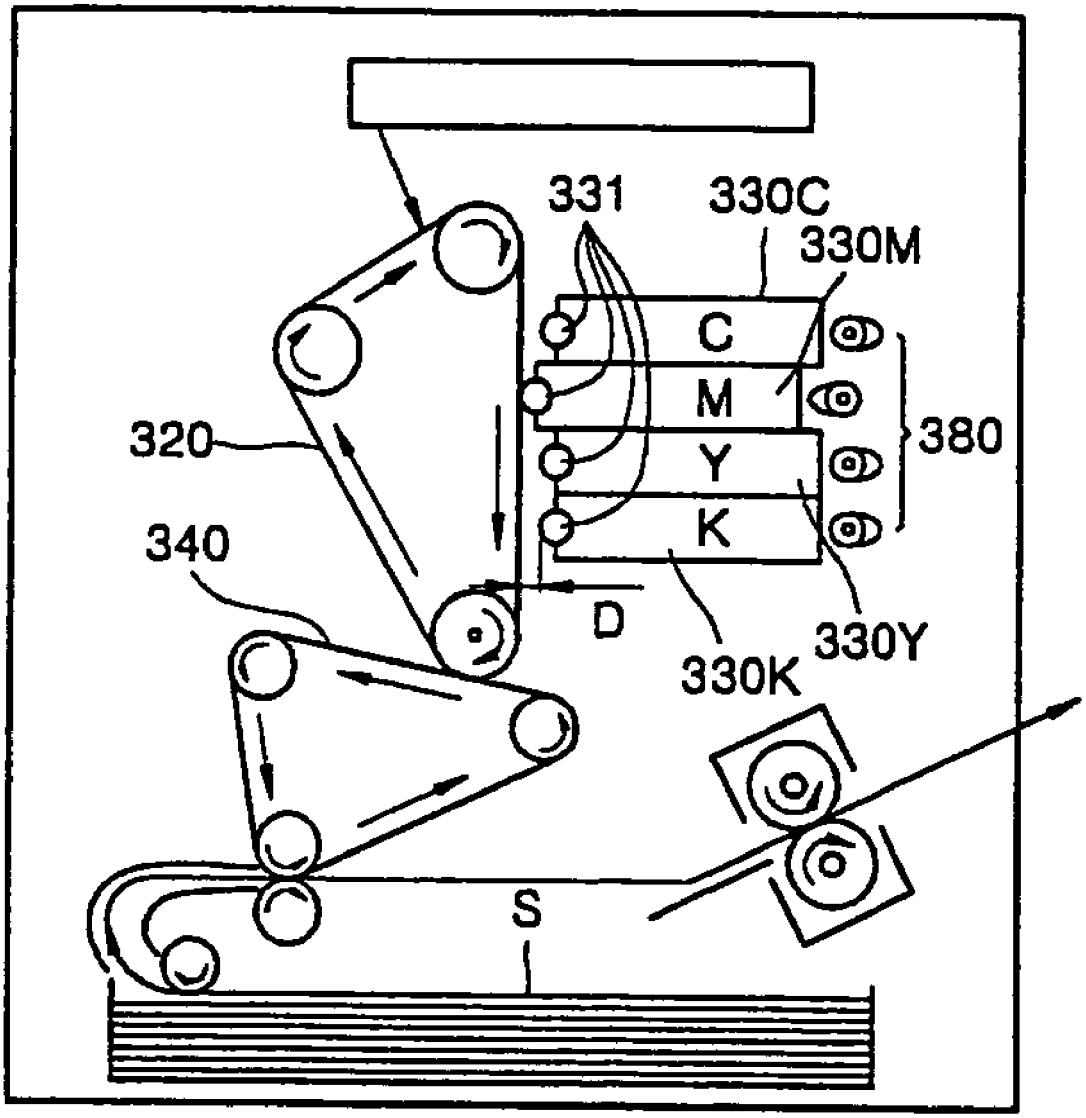
FIG. 3 (PRIOR ART)
FIG. 3 illustrates a conventional color image forming system using a slider method.

Reference will now be made in detail to the present preferred embodiments of the present invention, examples of which are illustrated in the accompanying drawings, wherein like reference numerals refer to like elements throughout.

Figure 4:
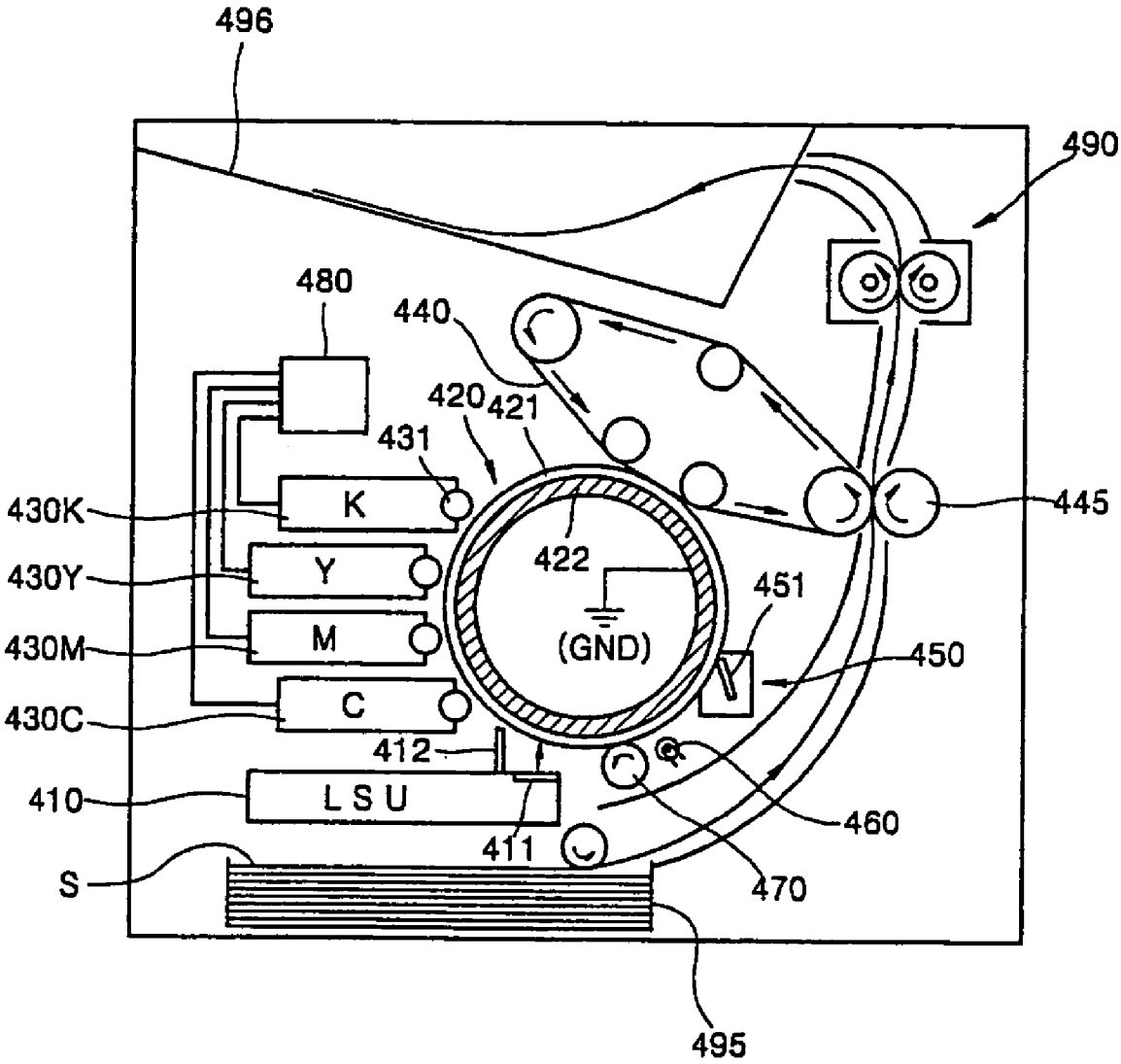
FIG. 4 illustrates a color image forming system according to an embodiment of the present invention.

FIG. 4 illustrates a color image forming system according to an embodiment of the present invention. As shown in FIG. 4, a charging roller 470, a laser scanning unit (LSU) 410, four developing units 430C, 430M, 430Y, and 430K, a transfer belt 440, a cleaning unit 450, and an electrostatic reset lamp 460 are provided at the outer surface of a rotating photosensitive drum 420. Also, a power supply unit 480, which supplies power to the four developing units 430C, 430M, 430Y, and 430K, is provided. In addition, a cassette 495 which supplies a piece of paper S, a transfer roller 445 which causes the piece of paper S to contact the transfer belt 440 so that a toner image is transferred from the transfer belt 440 onto the piece of paper S, and a fusing unit 490, which fuses a transferred toner image onto the piece of paper S, are provided.

In the present embodiment, the photosensitive drum 420, which includes an optical conductive material 421 coated on the outer surface of a metallic drum 422, is used as a photosensitive body. However, the form of the photosensitive body is not limited to this structure and a photosensitive belt may be used instead of a drum. The metallic drum 422 is electrically grounded. The photosensitive drum 420 rotates such that the linear velocity of the photosensitive drum 420 is the same as the transfer speed of the transfer belt 440.

In the present embodiment, the charging roller 470 is used to charge the photosensitive drum 420 to a uniform potential, but, alternately, a charger using corona discharge may be used to charge the photosensitive drum 420 to a uniform potential. The charging roller 470 contacts the outer surface of the photosensitive drum 420, rotates and supplies charge to the outer surface of the photosensitive drum 420 such that the outer surface of the photosensitive drum 420 has a uniform potential. The charge supplied by the charging roller 470 to the outer surface of the photosensitive drum 420 may be a positive or a negative charge. In the present embodiment, a negative charge is supplied to the outer surface of the photosensitive drum 420 such that the outer surface of the photosensitive drum 420 is charged to a negative potential.

The LSU 410 radiates light onto the rotating photosensitive drum 420 and forms an electrostatic latent image on the outer surface of the photosensitive drum 420. Since one LSU 410 is used in the present invention, the photosensitive drum 420 is sequentially exposed with image information of colors such as cyan (C), magenta (M), yellow (Y), and black (K), in a predetermined order.

The four developing units 430C, 430M, 430Y, and 430K, which store toners of cyan (C), magenta (M), yellow (Y), and black (K) colors, are fixed and placed near the outer surface of the photosensitive drum 420.

Figure 5:
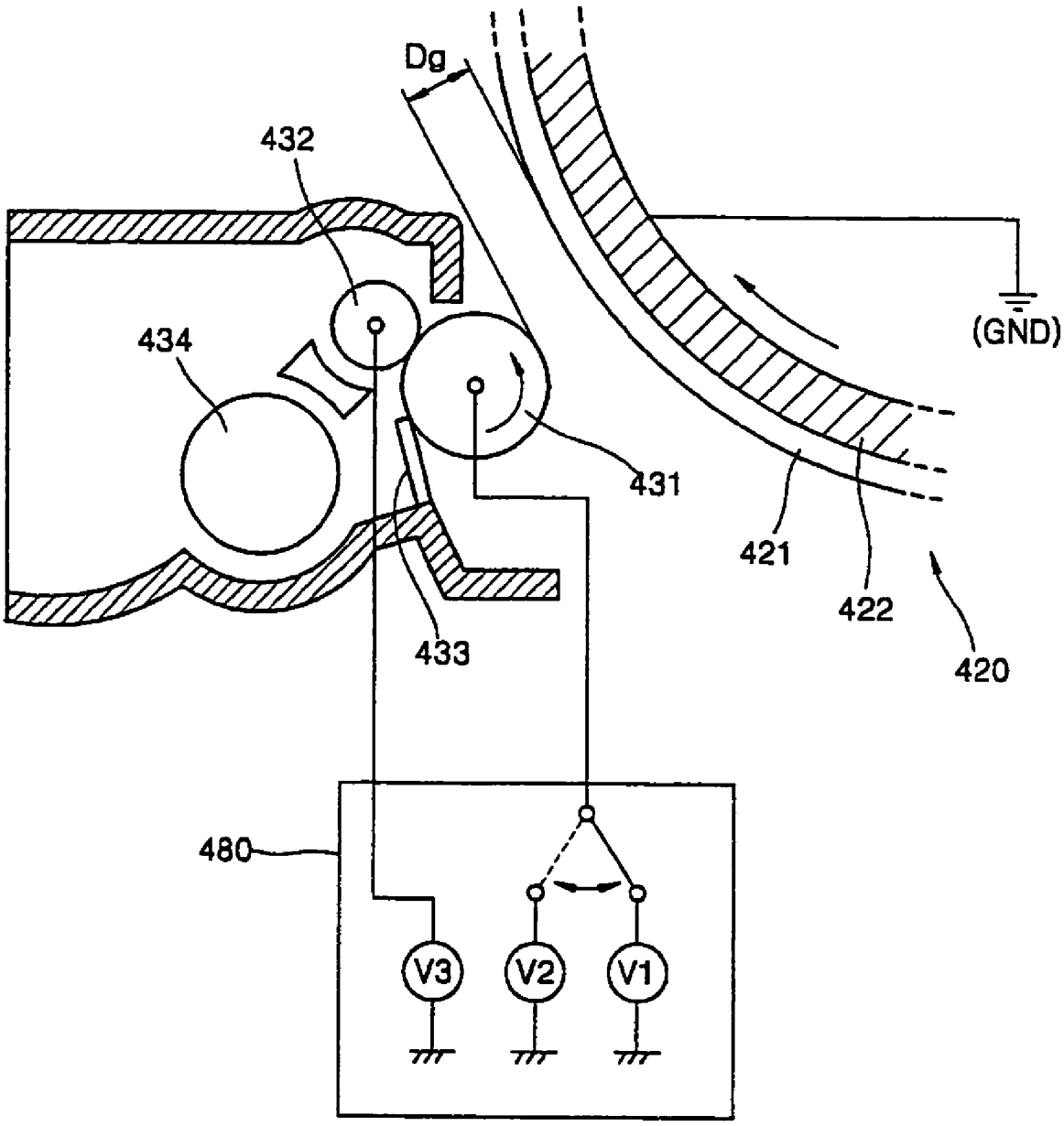
FIG. 5 illustrates a developing unit and a power supply unit shown in FIG. 4.

FIG. 5 illustrates one of the developing units 430C, 430M, 430Y, and 430K, and the power supply unit 480 shown in FIG. 4. Each of the developing units 430C, 430M, 430Y, and 430K includes a developing roller 431 which supplies toner to the electrostatic latent image formed on the photosensitive drum 420, a first roller 432 to which a third bias voltage V3 is applied and which attaches the toner to the developing roller 431, a regulating unit 433 which regulates the amount of the toner attached to the developing roller 431, and a second roller 434, which supplies the toner to the first roller 432 and the developing roller 431. The developing roller 431 may be formed of semiconductive rubber or metal.

When the plurality of developing units 430C, 430M, 430Y, and 430K are displaced, each developing roller 431 should be separated from the outer surface of the photosensitive drum 420 by a developing gap Dg. The toner may be nonmagnetic one-component toner. In the present embodiment, the toner is negatively charged in the developing units 430C, 430M, 430Y, and 430K.

The power supply unit 480 selectively applies a first bias voltage V1 and a second bias voltage V2 to the developing roller 431.

A potential difference between the developing roller 431 and the photosensitive drum 420 is formed by the first bias voltage V1 such that the toner goes across the developing gap Dg and attaches to the electrostatic latent image formed on the outer surface of the photosensitive drum 420, thereby developing the toner image for that color of toner. The first bias voltage V1 is applied to the developing roller 431 of the selected developing unit 430. The first bias voltage V1 has the same polarity as the toner. Since the negatively charged toner is used in the present embodiment, a negative bias voltage is applied to the developing roller 431 of the selected developing unit 430. The potential of the developing roller 431 generated by application of the first bias voltage V1 should be lower than the potential of the electrostatic latent image formed on the outer surface of the photosensitive drum 420, so that the negatively charged toner goes across the developing gap Dg and is attached to the electrostatic latent image with a higher potential. In the present embodiment, a DC bias voltage and an AC bias voltage, are together applied to the developing roller 431 of the selected developing unit 430 as the bias voltage V1.

The first bias voltage V1 is set in consideration of the size of the developing gap Dg, a development efficiency, and leakage characteristics. The development efficiency is determined by an optical density of the toner remaining on the developing roller 431 after solid printing is performed. The leakage characteristics are determined by the size of the first bias voltage V1 at which insulation is destroyed in the developing gap Dg between the developing roller 431 and the photosensitive drum 420, and leakage current flows through the photosensitive drum 420 from the developing roller 431.

Figure 6:
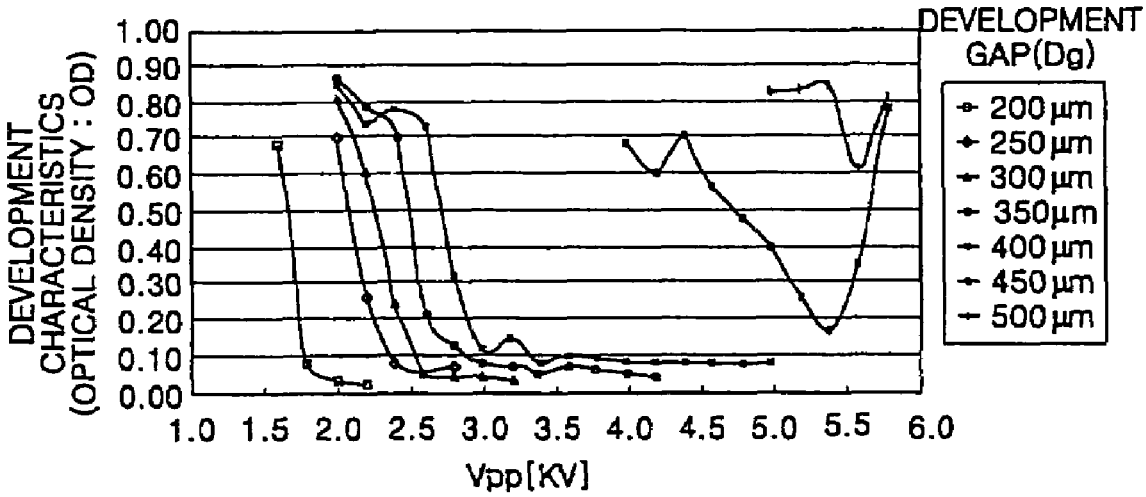
FIGS. 6 and 7 are graphs of experimentally obtained optical density data representing development characteristics plotted against a first bias voltage V1 applied to a developing roller, for different values of a developing gap, using color toners A and B, respectively.
Figure 7:
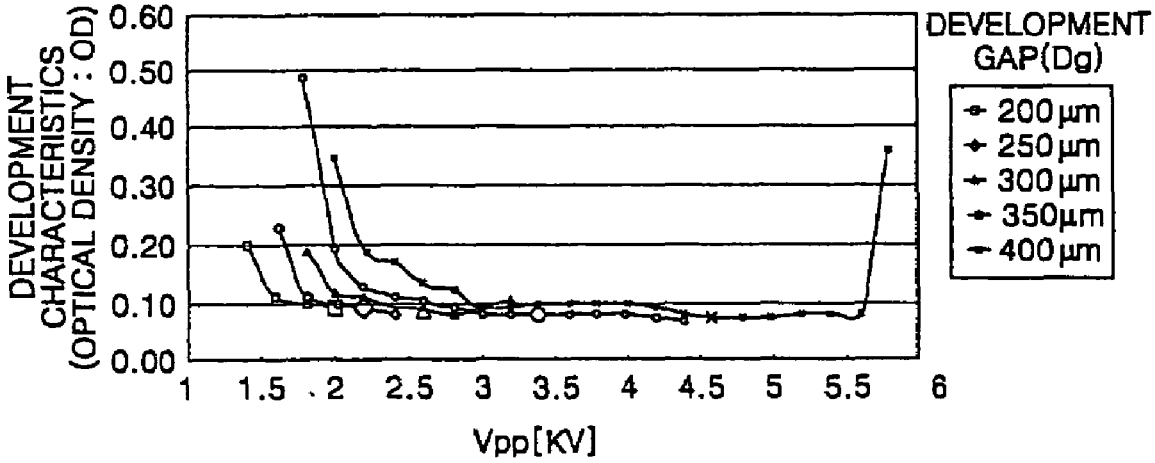
Figure 8:
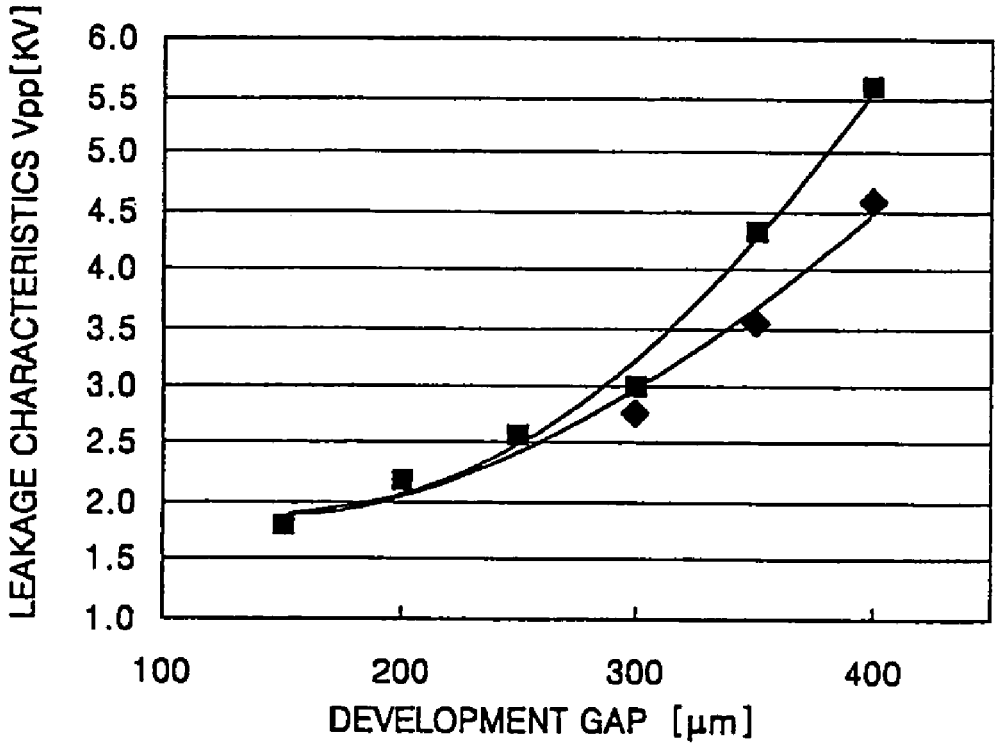
FIG. 8 is a graph of an experimentally measured leakage characteristic voltage versus the developing gap, for the color toners A and B.

FIGS. 6 and 7 are graphs of experimentally obtained optical density data representing development characteristics plotted against the peak-to-peak value Vpp of the first bias voltage V1 applied to the developing roller 431, for different values of the developing gap Dg, using color toners A and B, respectively. FIG. 8 is a graph of an experimentally measured leakage characteristic voltage versus the developing gap Dg, for the color toners A and B.

As the optical density of the toner remaining in the developing roller 431 becomes lower, the development efficiency becomes higher, and the developing gap Dg and the first bias voltage V1 are set so that the optical density is less than 0.1 within the range where leakage current does not occur. In this case, as the developing gap Dg increases, the size of the first bias voltage V1 increases. However, if the developing gap Dg increases excessively, the toner may leak out of the color image forming system. Thus, the developing gap Dg is set between 50 and 400 μm.

In contrast to the first bias voltage V1, the object of the second bias voltage V2 is to block movement of toner across the developing gap Dg. The second bias voltage V2 is applied to the developing rollers 431 of all of the unselected developing units 430. This is to prevent toner stored in the unselected developing units 430 from crossing the developing gap Dg and attaching to the photosensitive drum 420, and to prevent toner attached by the selected developing unit 430 to the electrostatic latent image on the photosensitive drum 420 from crossing back over the developing gap Dg and attaching to the developing roller 431 of an unselected developing unit 430. Here, the size of the second bias voltage V2 is experimentally set in relation to the developing gap Dg.

Figure 9:
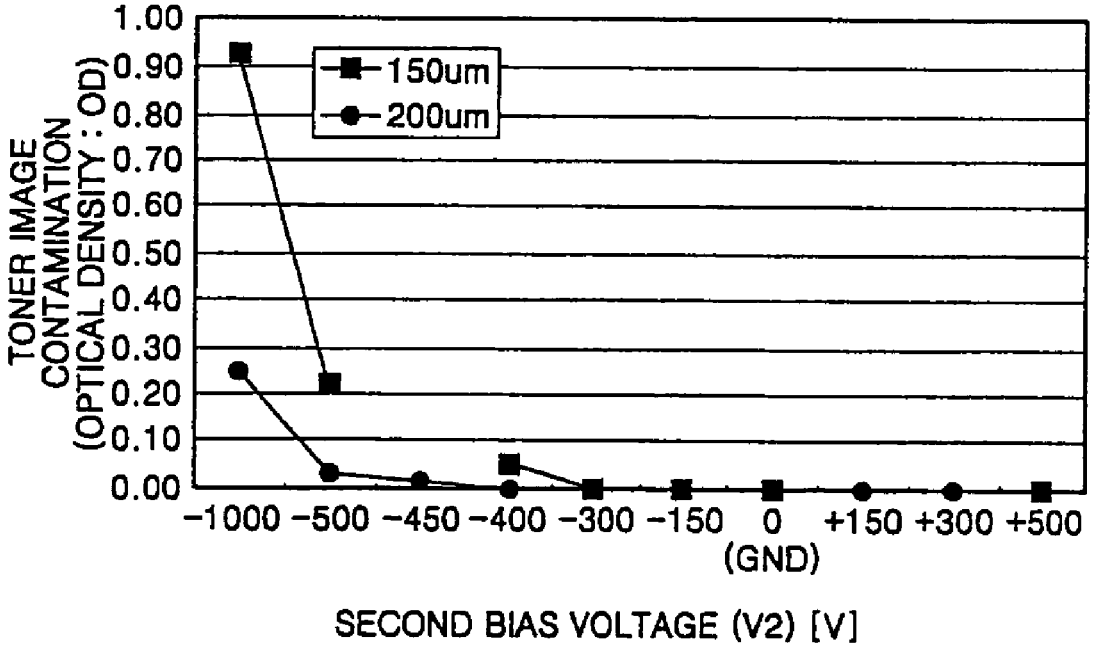
FIG. 9 is a graph of experimentally obtained optical density data indicating the amount of contamination of an electrostatic latent image plotted versus a second bias voltage V2 applied to the developing roller, for two different sizes of the developing gap.

FIG. 9 is a graph of experimentally obtained optical density data plotted versus the second bias voltage V2, for two different sizes of the developing gap Dg. Here, the optical density data indicates the amount of contamination of an electrostatic latent image on the photosensitive drum 420 by toner of unselected developing units 430.

Figure 10:
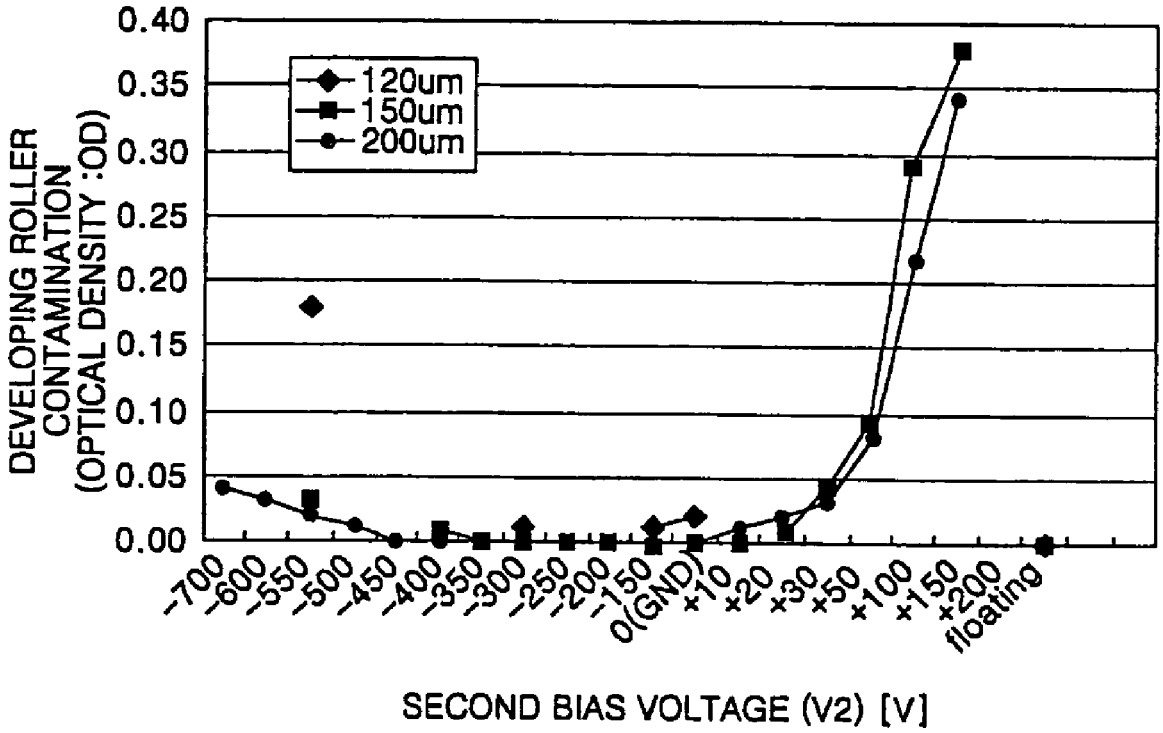
FIG. 10 is a graph of experimentally obtained optical density data indicating the amount of contamination of the surface of the developing roller plotted versus a second bias voltage V2 applied to the developing roller, for two different sizes of the developing gap.

FIG. 10 is also a graph of experimentally obtained optical density data plotted versus the second bias voltage V2, for two different sizes of the developing gap Dg. However, here the optical density data indicates the amount of contamination of the surface of the developing roller 420 by toner of other developing units 430.

The sizes of the developing gap Dg and the second bias voltage V2 are decided on the basis of the experimental data plotted in FIGS. 9 and 10. In general, a degree of image contamination of up to 0.03 optical density is considered to be acceptable. Accordingly, the developing gap Dg and the second bias voltage V2 are chosen to satisfy the requirement that image contamination be less than 0.03 optical density.

Referring to FIGS. 9 and 10, when the developing gap Dg is 150 μm, the second bias voltage V2 can be selected to be between about−300V and+10V, and when the developing gap Dg is 200 μm, the second bias voltage V2 can be selected to be between about−400V and 0V. In addition, the second bias voltage V2 can be electrically floated.

The transfer belt 440 receives toner images having four colors, such as cyan (C), magenta (M), yellow (Y), and black (K), which are transferred sequentially from the photosensitive drum 420, overlaps the toner images, and transfers the toner images onto the piece of paper S. In the present embodiment, the transfer belt 440 is used as a transfer body, but in an alternative embodiment, a transfer drum may instead be used as the transfer body. The length of the transfer belt 440 should be equal to or greater than the maximum length of the piece of paper S used in the color image forming system.

The cleaning unit 450 removes toner remaining on the outer surface of the photosensitive drum 420 after the transfer operation. In the present embodiment, a cleaning blade 451 that contacts the outer surface of the photosensitive drum 420 is used as the cleaning unit 450. Alternatively, a cleaning roller (not shown) that contacts the outer surface of the photosensitive drum 420 and rotates may be used as the cleaning unit 450.

In general, the electrostatic reset lamp 460 is used as an electrostatic reset unit and radiates light of a predetermined frequency and amplitude onto the outer surface of the photosensitive drum 420 to make the surface potential of the photosensitive drum 420 uniform.

An example of a method of forming a color image according to the present invention will be described below. However, methods of forming a color image from color image information containing information on cyan (C), magenta (M), yellow (Y), and black (K) colored toner images varies according to the order in which the different color toner images are developed. In the following example, it is assumed that toner image development is performed in the order of cyan (C), magenta (M), yellow (Y), and black (K).

First, the outer surface of the photosensitive drum 420 is charged by the charging roller 470 to a uniform potential and a light signal corresponding to image information of a cyan (C) color is radiated by the LSU 410 onto the optical conductive material 421 on the outer surface of the rotating photosensitive drum 420. This causes the resistance of a portion onto which light is radiated to be reduced and a charge attached to the outer surface of the photosensitive drum 420 flows out through the metallic drum 422. Thus, a potential difference is created between the irradiated portion and the non-irradiated portion of the outer surface of the photosensitive drum 420, such that an electrostatic latent image is formed thereon.

As the rotation of the photosensitive drum 420 brings the electrostatic latent image near the cyan developing unit 430C, the developing roller 431 of the cyan developing unit 430C begins to rotate. In this example, the developing rollers 431 of the other developing units 430M, 430Y, and 430K do not yet rotate. However, the image may still be developed if the other developing rollers 431 rotate. Also at this time, the first bias voltage V1 is applied to the developing roller 431 of the cyan developing unit 430C from the power supply unit 480, and the second bias voltage V2 is applied to the developing rollers 431 of the unselected developing units 430M, 430Y, and 430K. Accordingly, the toner of cyan (C) color crosses the developing gap Dg and attaches to the electrostatic latent image formed on the outer surface of the photosensitive drum 420, while toner of the other colors is prevented from crossing the developing gap Dg and attaching to the electrostatic latent image. In addition, the cyan toner attached to the electrostatic latent image is prevented from crossing back across the developing gap Dg and attaching to the developing roller 431 of one of the unselected developing units 430M, 430Y, and 430K. In this way, a toner image of cyan color is formed.

When rotation of the photosensitive drum 420 brings the toner image of cyan color into contact with the transfer belt 440, the cyan toner image is transferred onto the transfer belt 440 by the potential difference between the photosensitive drum 420 and the transfer belt 440 and a contact pressure thereof.

After the cyan toner image is completely formed on the transfer belt 440, toner images of magenta (M), yellow (Y), and black (K) colors are formed in that order by the same process used to form the cyan toner image and are overlapped upon one another to form a full color toner image on the transfer belt 440.

Then, when the piece of paper S supplied by the cassette 495 passes between the transfer belt 440 and the transfer roller 445, the color toner image formed on the transfer belt 440 is transferred onto the piece of paper S. Subsequently, the color toner image is fused onto the piece of paper S by the fusing unit 490 using heat and pressure, and the piece of paper S is discharged to a stacker 496, thereby completing the formation of the color image. Even when the four-color developing units 430 are maintained at the developing gap Dg and fixed, the development and transfer of color images can be performed smoothly and with high quality results.

When color images are developed as described above, image quality may be affected by the arrangement of the developing units 430 and the developing order. Hereinafter, factors that should be considered in order to determine the arrangement of the developing units and the developing order so as to ensure high image quality will be described.

First, it may be necessary to prepare for cross contamination of the four color developing units 430 when applying the second bias voltage V2 to the unselected developing units 430. In spite of the application of the second bias voltage V2 to the unselected developing units 430, some toner attached to the photosensitive drum 420 is transferred to the unselected color developing units 430 before being transferred onto the transfer belt 440. Such preparation may include arranging the four-color developing units 430K, 430Y, 430M, and 430C such that even if cross contamination occurs, image quality is affected as little as possible. Thus, the developing units 430 may be arranged in order of increasing darkness, with the lightest color in the lowermost portion of the photosensitive drum 420 where a development operation beings, and the darkest color in the uppermost portion of the photosensitive drum 420 where a development operation ends. With such an arrangement, even if toner on the photosensitive drum 420 is transferred back to the developing units 430 having different colors, it will always be transferred back to a developing unit 430 having a darker color. And, since the contaminant toner is of lighter color than the contaminated toner, the effect of the cross contamination is unnoticeable.

In actuality, if a lighter color toner is contaminated with a small amount of a darker color toner, as long as the contaminant is not black toner, which is the darkest, it is likely that the effect will not be noticeable. However, if any other color toner is contaminated with even a small amount of black toner, the effect will be very noticeable. Thus, while the order in which the other colors are arranged may be changed without much consequence, it is particularly important that the black developing unit 430K is always last along the traveling direction of the photosensitive drum 420, as shown in FIG. 4.

However, arranging the black developing unit 430K at the uppermost portion of the photosensitive drum 420 requires that it be completely structurally sealed. Otherwise, black toner could leak out of the black developing unit 430K and drip down and contaminate the toner in the developing units 430Y, 430M, and 430C. Thus, if the structural sealing of the developing units 430 is doubtful, the black developing unit 430K should still be installed at the uppermost portion of the photosensitive drum 420, but the developing unit 430Y having yellow toner, which is most affected by contamination by black toner, is arranged to be distant from the black developing unit 430K.

Next, the possibility of the LSU 410 being splattered with toner should be considered. The LSU 410 performs the function of radiating light onto the photosensitive drum 420 and forming an electrostatic latent image, and a precise electrostatic latent image can be formed only when a window 411 of the LSU 410 through which light passes is maintained in a clean state. Thus, if toner escapes from any of the developing units 430K, 430Y, 430M, and 430C, and contacts the window 411, it becomes difficult to form a precise electrostatic latent image. As expected, the effect of contact by the black toner is the greatest. This is because the amount of black toner used in printing a document is the largest in a color printer. Thus, the operational time of a black developing unit is the longest, and the amount of contamination caused by the black developing unit is the largest. Thus, black is more frequently used than the other three colors combined. Hence, the black developing unit 430K may be placed in the furthest position from the LSU 410 in order to keep the window 411 of the LSU 410 as clean as possible. In addition, a toner blocking wall 412 may be installed beside the window 411 to block stray toner from reaching the window 411. Furthermore, a toner exhausting fan (not shown) may be installed around the window 411 such that toner around the window 411 is blown away and the window 411 is maintained in a clean state.

Next, the thermal characteristics of the toner for each color should be considered. In general, the softening temperature of toners of yellow, magenta, and cyan colors is set to be lower than that of a black toner. In general, this is because while a black image is formed of a single layer of black toner, a color image is formed of several overlapping layers of different color toners such as yellow, magenta, and cyan. In order to obtain transparent characteristics of color toners, similar to transparent characteristics of a black image transferred on an OHP film, a softening temperature Ts of the color toners should be set to be lower. The softening temperature of black toner is about 130° C., and the softening temperature of the other color toners is about 122° C. However, the fusing unit 490 that heats and compresses the piece of paper S is installed above the photosensitive drum 420 in order to fuse images transferred onto the piece of paper S. Thus, the heat of the fusing unit 490 may be transferred to the developing unit 430 and thus may deteriorate the characteristics of the toner. To minimize the possible effects of heat from the fusing unit 490, the developing unit 430 having the most heat resistant toner, i.e., the black developing unit 430K, may be arranged nearest to the fusing unit 490. Thus, again the black developing unit 430K is installed in the uppermost position, nearest the fusing unit 490.

Next, the amount of time existing and the amount of time required between the end of a developing operation performed by one developing unit and the beginning of a developing operation performed by the next developing unit should be considered. Taking, for example, the color image forming system according to the present invention shown in FIG. 4, and assuming that the diameter of the photosensitive drum 420 is 120 mm and the development speed is 125.6 mm/sec using the four developing units 430K, 430Y, 430M, and 430C, the following is evident. If the developing order is cyan, magenta, yellow, and then black, after the cyan developing unit 430C completes a developing operation, the photosensitive drum 420 should rotate, transferring the cyan toner image onto the transfer belt 440 during rotation, beyond the point where the developing operation performed by the cyan developing unit 430C began, so that the magenta developing unit 430M can begin to develop a magenta toner image. That is, after one complete rotation, the point where the development of the cyan color started on the photosensitive drum 420 is further advanced by rotation to the front of the magenta developing unit 430M. This further rotation is necessary so that development of the magenta toner image begins at the exact same point on the photosensitive drum 420 where development of the cyan toner image began, and hence the different color toner images can be perfectly overlapped on the transfer belt 440. Similarly, a little more than one complete rotation of the photosensitive drum is necessary when magenta and yellow toner images are developed successively, and when yellow and black toner images are developed successively as well.

Assuming that the photosensitive drum 420 having the diameter of 120 mm is used, and the development speed of the photosensitive drum 420 is 126 mm/sec, so as to print a color document at the printing speed of five sheets per minute, based on the specifications of the color image forming system taken as an example above, the amount of time existing between when one developing unit completes a developing operation and the next developing operation begins is about 0.73 seconds on average. This amount of time is quite enough to perform the necessary reallocation of the first and second bias voltages V1 and V2. However, when the black developing unit 430K and the cyan developing unit 430C perform successive developing operations, after development and transfer of the black toner image, the point on the photosensitive drum 420 where development of the black toner image began arrives at the cyan developing unit 430C after only half a revolution. This provides very little time in which to reallocate the first and second bias voltages V1 and V2. In fact, the point on the photosensitive drum 420 where development of the black toner image began may arrive at the cyan developing unit 430C even before development of the black toner image is finished.

One possible solution to this problem is to make the photosensitive drum 420 make an additional revolution to provide more than enough time to reallocate the first and second bias voltages V1 and V2 before the cyan developing unit 430C begins its developing operation. However, printing speed is reduced from five sheets per minute to four sheets per minute. Thus, if the black developing unit 430K is replaced with the cyan developing unit 430C, this provides little time in which to reallocate the first and second bias voltages V1 and V2. This also provides a case where the black developing-unit 430K must be replaced with the cyan developing unit 430C before the black developing unit 430K finishes the developing operation.

Another way to solve the problem is to use one high pressure converter to trigger application of the first bias voltage V1 for development by the black developing unit 430K, and another separate high pressure converter to trigger application of the first bias voltage V1 for development by the cyan developing unit 430C. However, to do this, material costs increase.

Yet another possible solution might be to change the developing order to proceed downward starting from the black developing unit 430K installed in the uppermost position. In this case, the point where the development of black color starts on the photosensitive drum 420 arrives at the yellow developing unit 430Y after just short of one revolution. The same goes for successive developing operations of yellow and magenta, and of magenta and cyan. In this case, the time between when one developing unit completes a developing operation and the next one begins is about 0.32 seconds on average, and is enough to reallocate the first and second bias voltages V1 and V2. When the initial development of the black color is performed after the development of the cyan color is completed, the photosensitive drum 420 makes one revolution and further rotates by the point facing the black developing unit 430K. Thus, another developing unit 430 is prevented from starting a development operation before the development of one developing unit 430 is completed.

Thus, considering the time to complete a development operation, the development operation may be performed in the development order from upward to downward. However, as described above, if the black color is developed first, a serious problem could occur in which black toner is scattered on a transfer belt and a boundary between images is not clear, but instead appears blurry (described later), could occur, and thus the black color cannot be developed first. Thus, in the arrangement of FIG. 4, if either the yellow developing unit 430Y placed under the black developing unit 430K performs a development operation first, the magenta developing unit 430M performs a development operation second, the cyan developing unit 430C performs a development operation third, or the yellow developing unit 430Y placed under the black developing unit 430K performs a development operation first, the cyan developing unit 430C performs a development operation second, the magenta developing unit 430M performs a development operation third, and the black developing unit 430K performs a development operation last, there is sufficient time for reallocating the first and second bias voltages V1 and V2, and the effects of cross contamination can be reduced.

Next, factors related to the scattering, transfer and fusing characteristics of color toners should be considered. When toner is transferred onto the piece of paper S, it may be slightly scattered from its intended position because toner that has already been transferred onto the transfer belt 440 from the photosensitive drum 420 is affected by a transfer voltage applied when a next color toner is transferred, or because toner transferred onto the transfer belt 440 vibrates by vibration before the toner is transferred onto the piece of paper S. However, the image of the color that is first developed and transferred onto the transfer belt 440 must make three revolutions on the transfer belt 440 before the other three colors are developed, transferred, and the full color image is completed. Thus, the probability that the toner that is first developed and transferred onto the transfer belt 440 will be scattered, is highest. Now, considering that such scattering is most visible when the toner is black, less visible when the toner is cyan, still less visible when the toner is magenta, and least visible when the toner is yellow, the developing may be performed in the order of either yellow first, magenta second, cyan third, and black or yellow first, cyan second, magenta third, and black last.

Figure 11:
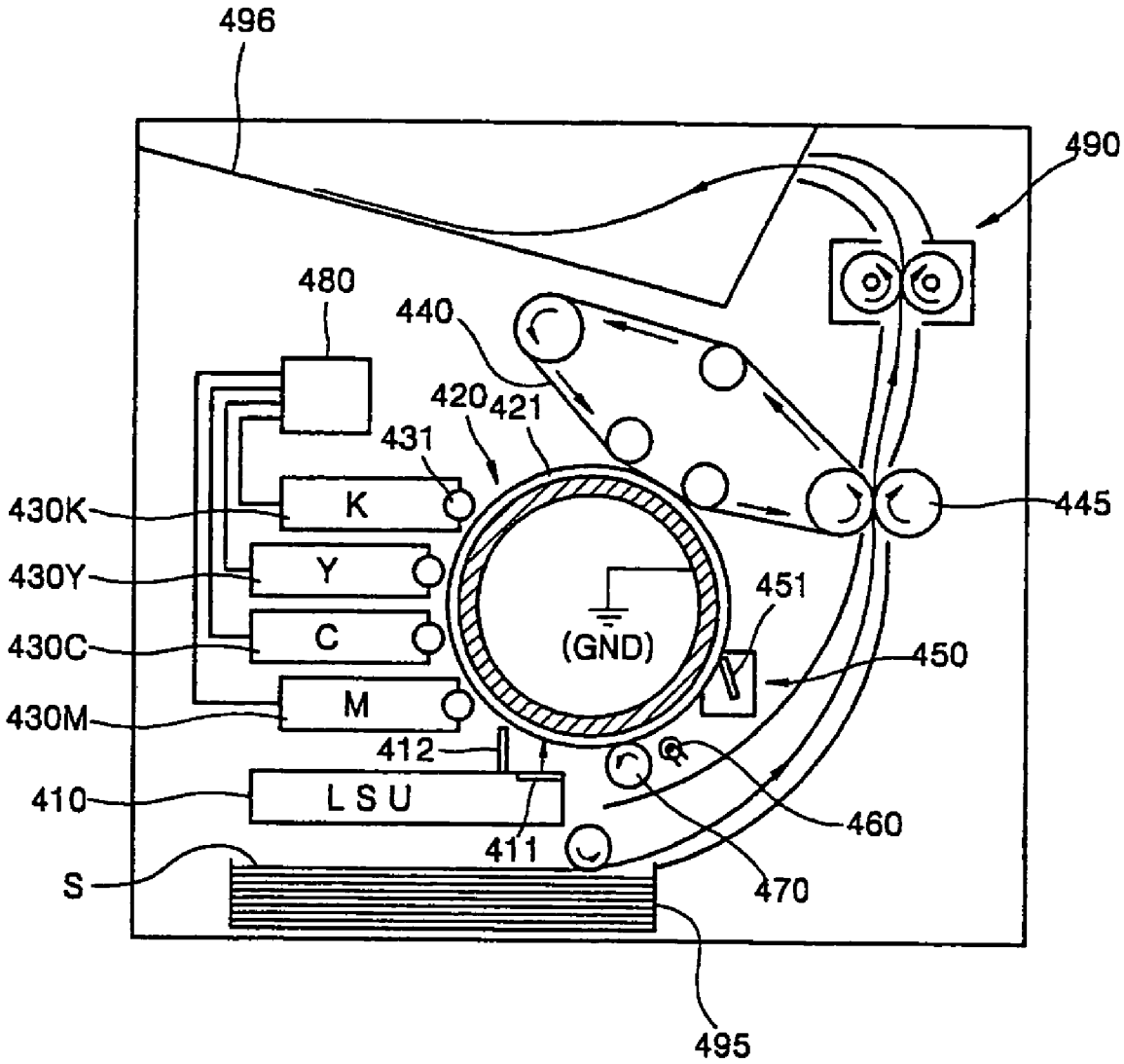
FIG. 11 illustrates an example in which developing units for each color are arranged in the color image forming system according to the embodiment of the present invention.

After considering all of the above factors, the developing units 430 may be arranged as shown in FIG. 4 or 11. That is, considering all of the factors, the black developing unit 430K may be placed in the upper portion, where it is furthest from the LSU 410 and nearest to the fusing unit 490, and the development of the black color is best performed last. The development of the other colors may be performed from brightest to darkest color in consideration of the effects of cross contamination. Thus, the developing order should be either yellow first, magenta second, cyan third, and black last or yellow first, cyan second, magenta third, and black last. And, if the developing units 430 are sequentially arranged downward in consideration of the time between one developing unit 430 finishing a developing operation and the next developing unit 430 beginning a developing operation, the developing units 430 arranged in the order of either cyan, magenta, yellow, and black from bottom to top, as shown in FIG. 4, or magenta, cyan, yellow, and black from bottom to top, as shown in FIG. 11.

Therefore, in order to obtain high image quality, the developing units may be arranged in the order of either cyan, magenta, yellow, and black or magenta, cyan, yellow, and black, upward along the outside of the photosensitive drum 420, and developing is performed in the order of either yellow first, magenta second, cyan third, and black last or yellow first, cyan second, magenta third, and black last.

Figure 12:
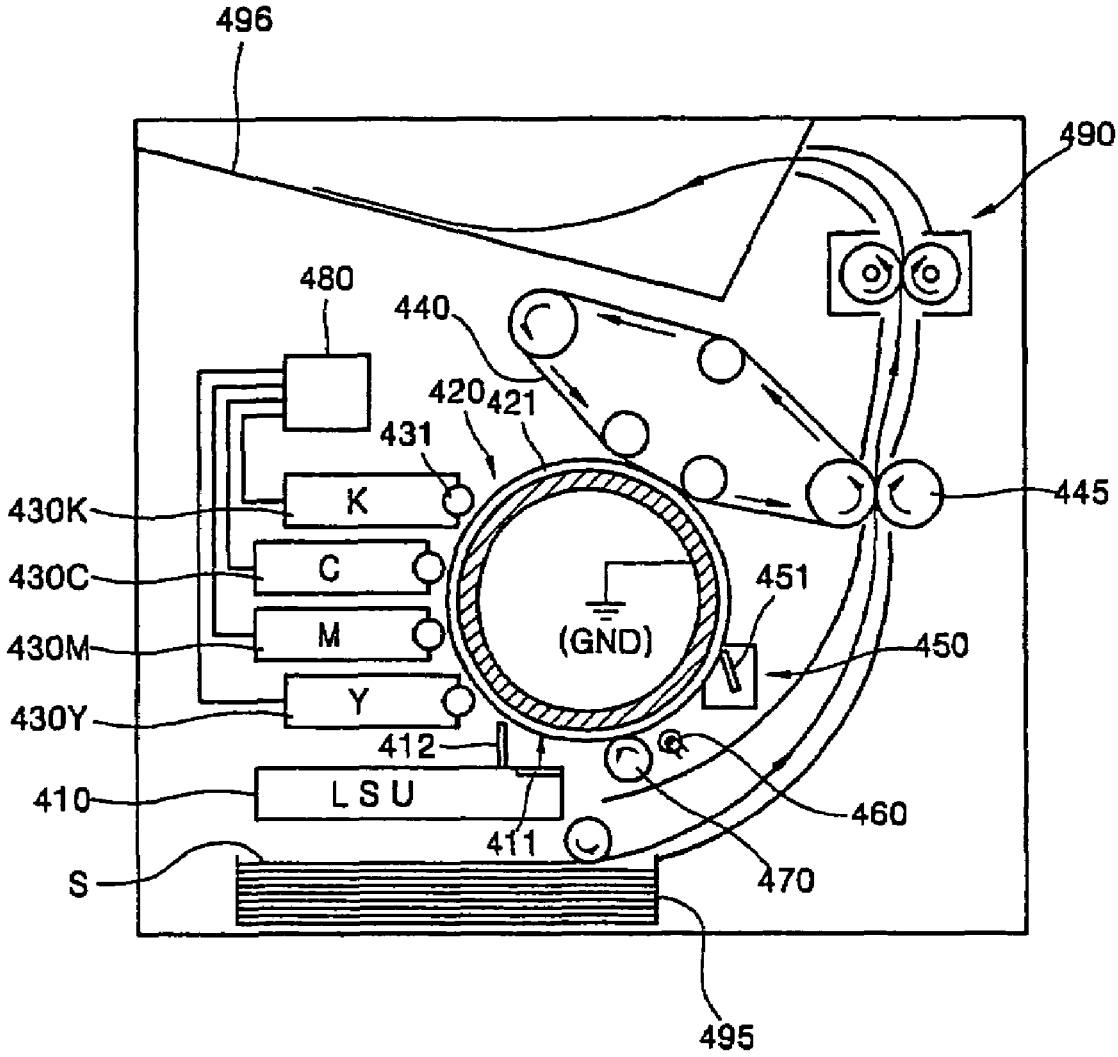
FIG. 12 illustrates another example in which the developing units for each color are arranged in the color image forming system according to the embodiment of the present invention.

Meanwhile, the arrangement of the developing units 430 for each color is based on the premise that the structural sealing of the developing units 430 is sufficiently reliable. If there is a significant possibility of toner in the developing units 430 leaking or otherwise escaping from the developing units 430, the yellow developing unit 430Y may be positioned as distant from the black developing unit 430K as possible. This is because the effects of cross contamination are most severe when the black toner contaminates the yellow toner. Thus, in this case, the yellow developing unit 430Y may be placed in the lowermost position and the developing units 430 are arranged in the order of yellow, magenta, cyan, and black, as shown in FIG. 12.

As described above, the color image forming system and the method of forming a color image according to the embodiments of the present invention have the following effects. First, developing units are fixed such that noise caused by sliding or rotation of the developing units as in the conventional color image forming system does not occur. Second, a driving mechanism has a simple configuration due to omission of a structure to slide or rotate the developing units 430, such that the color image forming system is more reliable and has a longer lifespan. Third, color images can be formed using one photosensitive body and one LSU, a structure to slide or rotate the developing units can be omitted, and thus material costs are reduced. Fourth, deterioration of image quality caused by the vibration of the system can be prevented by minimizing the number of moving parts in the system. Fifth, developing can be performed by properly arranging the developing units for each color so that the effects of cross contamination are minimized and high image quality is obtained.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A color image forming system comprising:

a photosensitive drum;

a charger which charges the photosensitive drum;

a laser scanning unit which is installed opposite a first side of the photosensitive drum, radiates light onto the charged photosensitive drum, and forms an electrostatic latent image thereon;

a plurality of developing units respectively having toners of yellow, magenta, cyan, and black, arranged at different heights relative to an outer surface of the photosensitive drum, to develop the electrostatic latent image with the toners, the developing units each comprising a developing roller maintained at a developing gap with respect to the photosensitive drum;

a transfer unit which transfers the developed image onto a piece of paper; and a fusing unit which is installed opposite a second side of the photosensitive drum and fuses the transferred image onto the piece of paper, wherein the developing units are arranged based on the respective toner colors in the order of magenta, cyan, yellow, and black from the laser scanning unit to the fusing unit.

2. A method of forming a color image comprising:

preparing a photosensitive drum, a charger which charges the photosensitive drum, a laser scanning unit which is installed below the photosensitive drum, radiates light onto the charged photosensitive drum, and forms an electrostatic latent image thereon, a plurality of developing units respectively having toners having colors of magenta, cyan, yellow, and black, arranged at different heights relative to an outer surface of the photosensitive drum, to develop the electrostatic latent image with the toner when a developing roller installed in each of the developing units is maintained at a developing gap with respect to the photosensitive drum, a transfer unit which transfers the developed image onto a piece of paper, and a fusing unit which is installed above the photosensitive drum and fuses the transferred image onto the piece of paper;

developing a plurality of monochromatic images using the developing units and overlapping the monochromatic images on the transfer unit to produce a full color image;

transferring the full color image onto the piece of paper using the transfer unit; and fusing the transferred image onto the piece of paper using the fusing unit, wherein the developing units are arranged based on the respective toner colors in the order of magenta, cyan, yellow, and black from the laser scanning unit to the fusing unit, and the developing is performed in the order of yellow, cyan, magenta, and black.

* * * * *